US009837740B2

(12) United States Patent
Liao

(10) Patent No.: US 9,837,740 B2
(45) Date of Patent: Dec. 5, 2017

(54) ELECTRICAL CONNECTOR

(71) Applicant: FOXCONN INTERCONNECT TECHNOLOGY LIMITED, Grand Cayman (KY)

(72) Inventor: Fang-Jwu Liao, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/262,357

(22) Filed: Sep. 12, 2016

(65) Prior Publication Data

US 2017/0077632 A1 Mar. 16, 2017

(30) Foreign Application Priority Data

Sep. 10, 2015 (CN) ..... 2015 2 0697925 U

(51) Int. Cl.

| | |
|---|---|
| ***H01R 12/77*** | (2011.01) |
| ***H01R 9/24*** | (2006.01) |
| ***H01R 13/405*** | (2006.01) |
| ***H01R 13/6585*** | (2011.01) |
| ***H01R 24/28*** | (2011.01) |
| *H01R 13/6586* | (2011.01) |
| *H01R 24/58* | (2011.01) |
| *H01R 24/60* | (2011.01) |

(52) U.S. Cl.

CPC ..... *H01R 12/775* (2013.01); *H01R 9/2491* (2013.01); *H01R 13/405* (2013.01); *H01R 13/6585* (2013.01); *H01R 24/28* (2013.01); *H01R 13/6586* (2013.01); *H01R 24/58* (2013.01); *H01R 24/60* (2013.01)

(58) Field of Classification Search

CPC .. H01R 12/775; H01R 9/2491; H01R 13/405; H01R 13/6585

USPC ..... 439/499

See application file for complete search history.

(56) References Cited

U.S. PATENT DOCUMENTS 5,425,651 A * 6/1995 Thrush ..... H01R 12/83 439/326

7,585,188 B2 * 9/2009 Regnier ..... H01R 12/721 439/637

(Continued)

FOREIGN PATENT DOCUMENTS

| | | |
|---|---|---|
| TW | M267697 | 6/2005 |
| TW | M393890 | 12/2010 |

*Primary Examiner* — Alexander Gilman

(74) *Attorney, Agent, or Firm* — Wei Te Chung; Ming Chieh Chang

(57) ABSTRACT

An electrical connector comprises a plurality of first terminal blocks and a plurality of second terminal blocks stacked together along a first direction. The first terminal block and the second terminal block are stacked one by one. Each of the first terminal block and the second terminal block has a first insulative plate and a plurality of first terminals fixed in the first insulative plate. The first terminals are arranged along a second direction perpendicular to the first direction. The first terminal extends along a third direction perpendicular to the first direction and the second direction. The first terminal has a deflectable contacting arm and a connecting foot, and the deflectable contacting arm of the first terminal block and the deflectable contacting arm of the second terminal block bend in a face to face style to form an inserting space in the first direction.

17 Claims, 8 Drawing Sheets

(56) References Cited

U.S. PATENT DOCUMENTS 7,625,243 B2 * 12/2009 Chen ..... H01R 23/6873 439/541.5
7,651,379 B1 * 1/2010 Wu ..... H01R 12/62 439/108
7,785,140 B2 * 8/2010 Henry ..... H01R 13/514 439/541.5
8,152,568 B2 * 4/2012 Wu ..... H01R 13/6658 439/353
8,740,643 B2 * 6/2014 Kuang ..... H01R 12/721 439/541.5
8,858,237 B2 * 10/2014 Hsu ..... H01R 12/724 439/60
8,956,167 B2 * 2/2015 Wu ..... H01R 13/40 439/497
9,306,345 B2 * 4/2016 Hsu ..... H01R 13/6582
9,437,982 B2 * 9/2016 Wu ..... H01R 43/20
9,472,905 B2 * 10/2016 Peng ..... H01R 13/6658
9,478,884 B2 * 10/2016 Tsai ..... H01R 12/724
2011/0003514 A1 * 1/2011 Nguyen ..... H01R 13/6658 439/660
2011/0070779 A1 * 3/2011 Zhang ..... H01R 12/712 439/660
2011/0249948 A1 * 10/2011 Wu ..... G02B 6/3817 385/89
2012/0315796 A1 * 12/2012 Pang ..... H01R 13/6471 439/626
2013/0005164 A1 * 1/2013 Smink ..... H01R 13/6597 439/92
2013/0196550 A1 * 8/2013 Casher ..... H01R 12/724 439/660
2013/0309906 A1 * 11/2013 De Geest ..... H01R 13/646 439/607.31
2014/0302719 A1 * 10/2014 Ho ..... H01R 12/721 439/629

* cited by examiner

ELECTRICAL CONNECTOR

FIELD OF THE INVENTION

The present invention relates to an electrical connector.

DESCRIPTION OF THE PRIOR ART

Taiwan Patent Issued No. M393890 discloses an electrical connector including an insulative housing, a plurality of terminals received in the insulative housing and a shell covering the insulative housing. The insulative housing has a mating space for receiving a mating connector. The terminal has a mating portion protruding into the mating space. When the electrical connector is mating with a card edge of a Central processing unit, a height of the electrical connector and the number of the terminals are unchangeable.

It is desired to obtain a new electrical connector.

SUMMARY OF THE INVENTION

Accordingly, an object of the present invention is to provide an electrical connector comprising a plurality of first terminal blocks and a plurality of second terminal blocks stacked together along a first direction. The first terminal block and the second terminal block are stacked one by one. Each of the first terminal block and the second terminal block has a first insulative plate and a plurality of first terminals fixed in the first insulative plate. The first terminals are arranged along a second direction perpendicular to the first direction. The first terminal extends along a third direction perpendicular to the first direction and the second direction. The first terminal has a deflectable contacting arm and a connecting foot, and the deflectable contacting arm of the first terminal block and the deflectable contacting arm of the second terminal block bend in a face to face style to form an inserting space in the first direction.

DESCRIPTION OF PREFERRED EMBODIMENT

Reference will now be made to the drawings to describe the present invention in detail.

Figure 1:
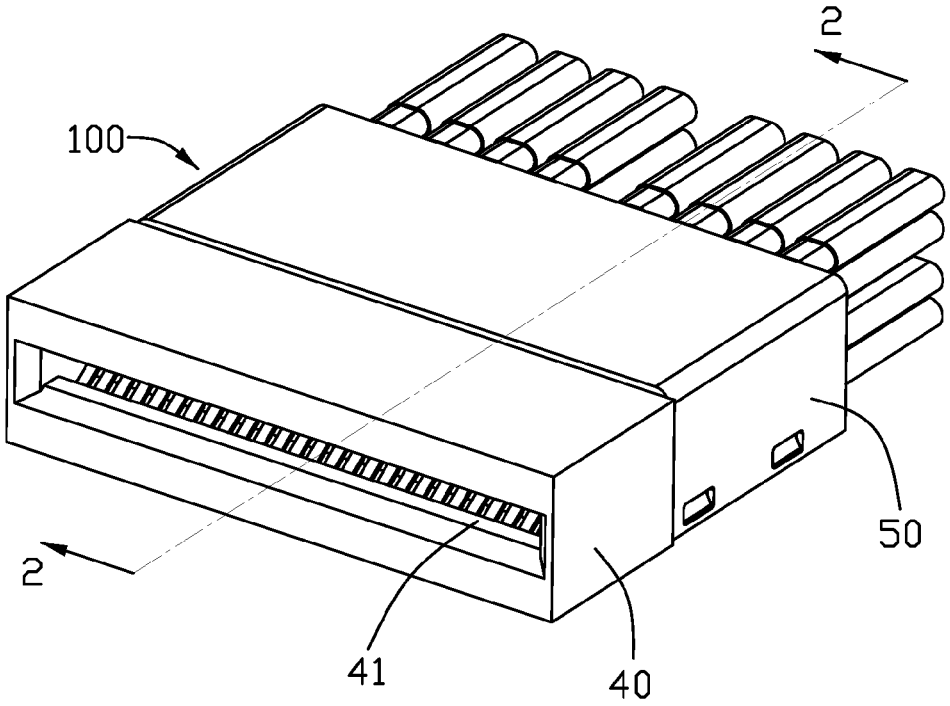
FIG. 1 is a perspective view of an electrical connector and a cable in accordance with the present invention.
Figure 2:
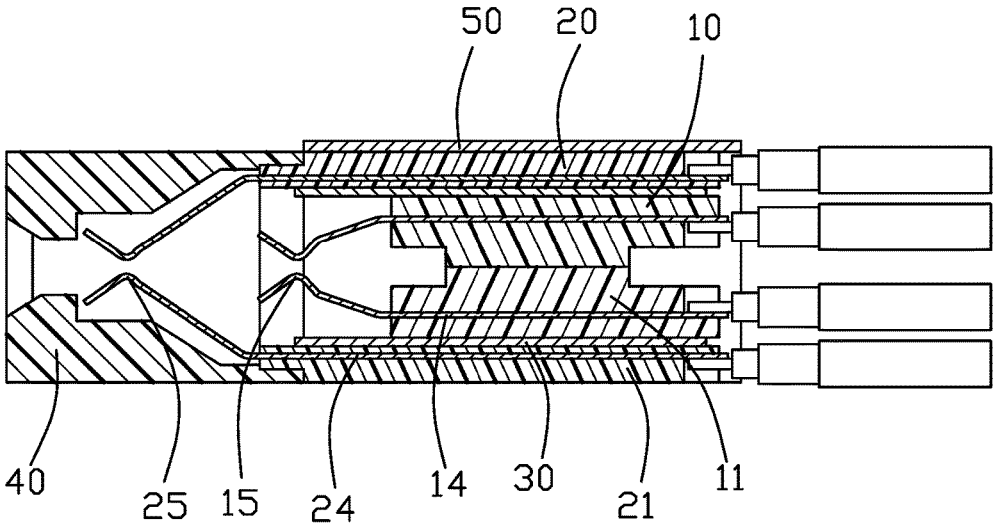
FIG. 2 is a cross-sectional view along line 2-2 shown in FIG. 1.

Referring to FIGS. 1-2, an electrical connector 100 is used for mating with a card edge of a Central Processing Unit. The electrical connector 100 includes a plurality of terminal blocks stacked together in a vertical direction, an insulative shell 40 and a shielding shell 50. The insulative shell 40 and the shielding shell 50 cover the terminal blocks. The shielding shell 50 is located behind the insulative shell 40.

Figure 6:
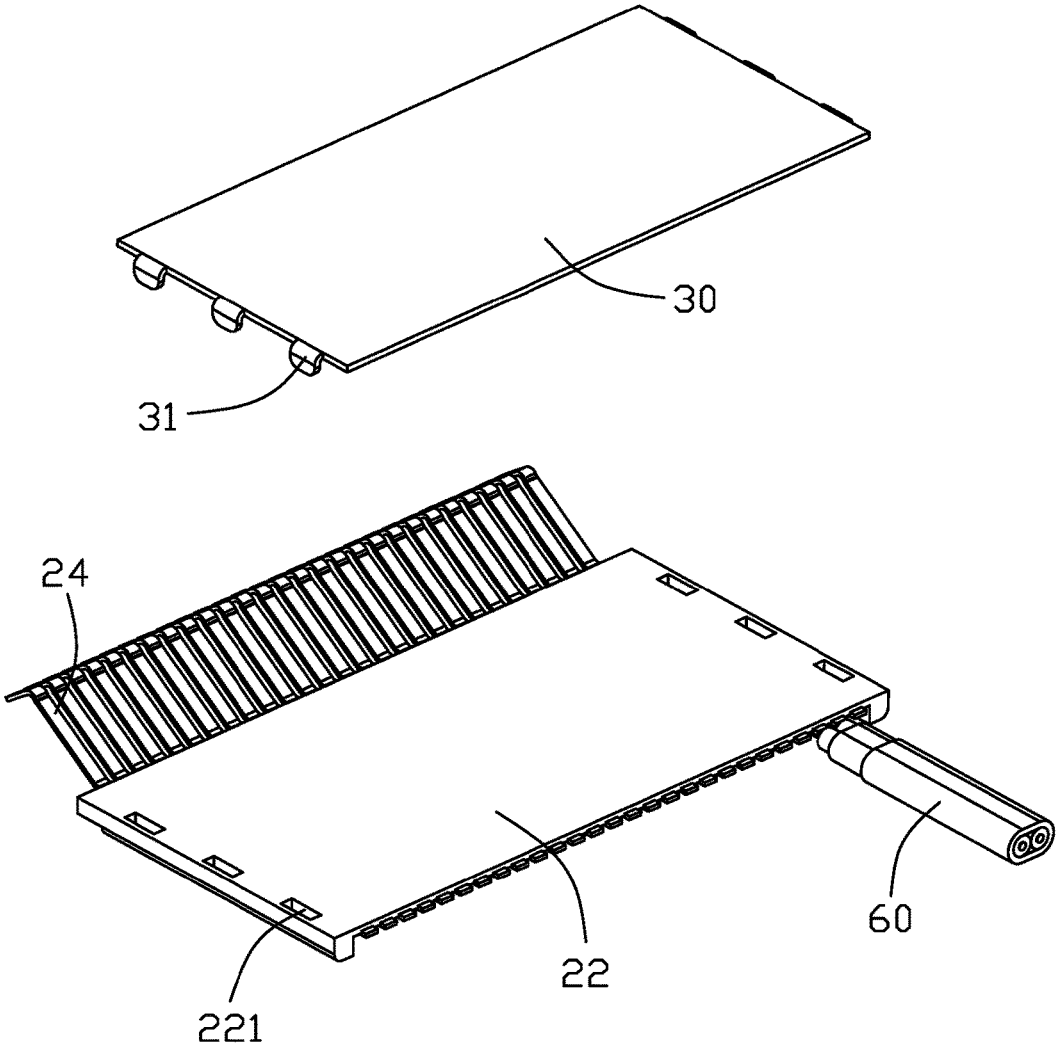
FIG. 6 is an exploded perspective view of a third terminal block and a shielding plate shown in FIG. 3.
Figure 7:
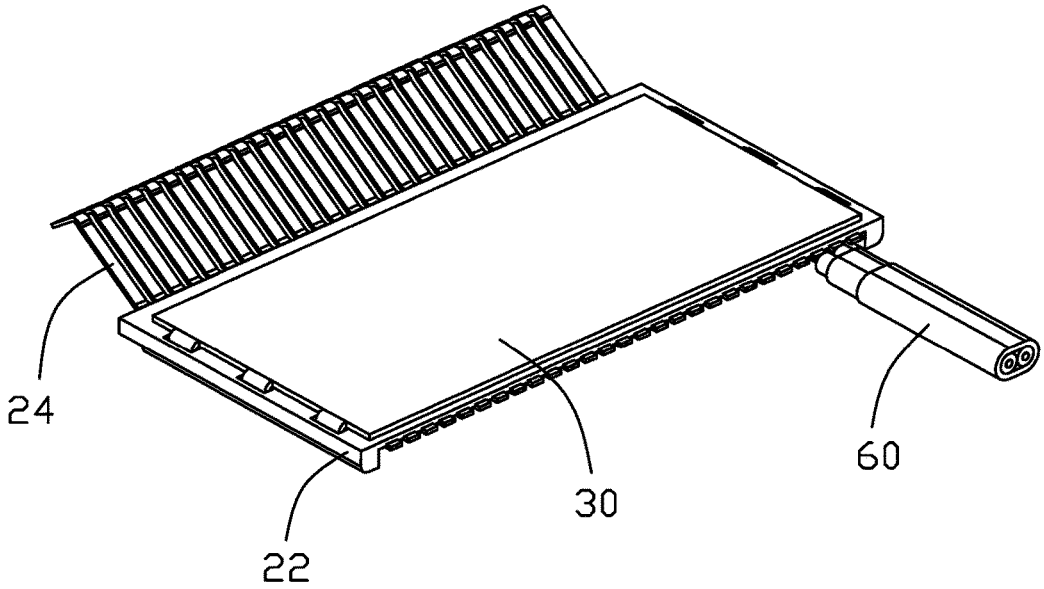
FIG. 7 is an assembling perspective view of the third terminal block and the shielding plate shown in FIG. 6.
Figure 8:
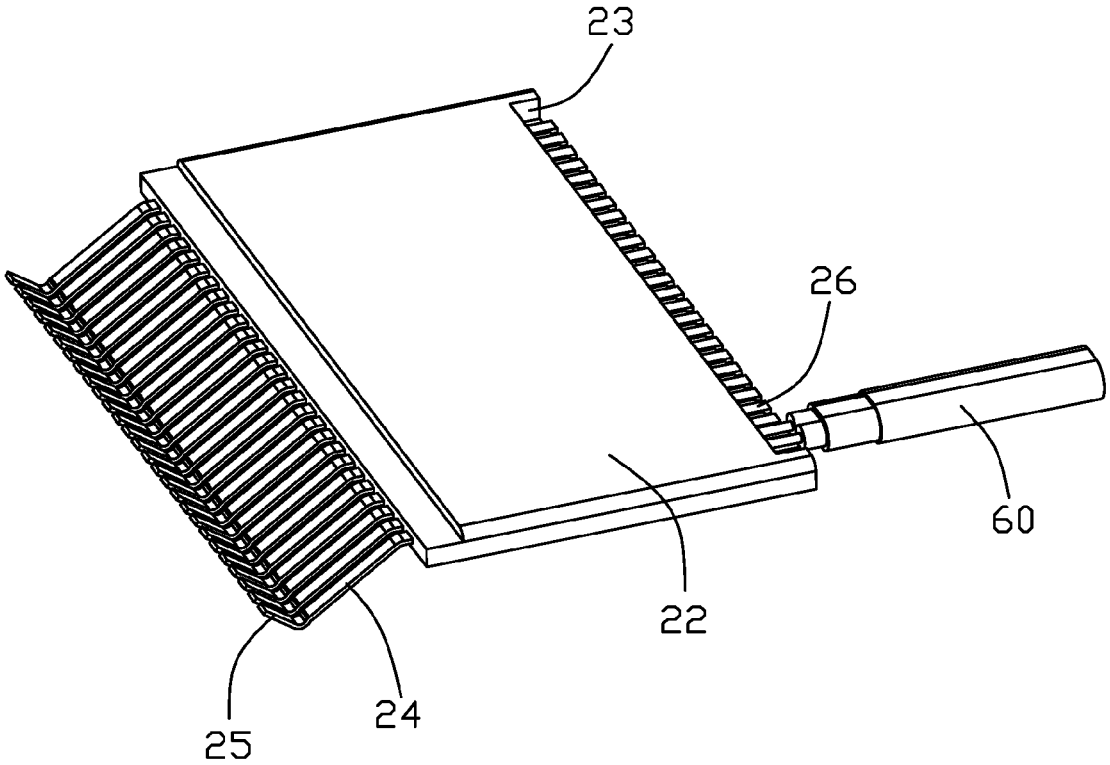
FIG. 8 is another assembling perspective view shown in FIG. 7.

Referring to FIGS. 2-8, the terminal blocks includes a first terminal block 10, a second terminal block 11, a third terminal block 20 and a fourth terminal block 21. The third terminal block 20 is stacked at a lateral side of the first terminal block 10. The fourth terminal block 21 is stacked at a lateral side of the second terminal block 11. The structure of the first terminal block 10 is same as the structure of the second terminal block 11. The structure of the third terminal block 20 is same as the structure of the fourth terminal block 21. The first terminal block 10 includes a first insulative plate 12 and a plurality of first terminals 14 fixed in the first insulative plate 12. The first insulative plate 12 of the first terminal block 10 and the first insulative plate 12 of the second terminal block 11 are shaped as a horizontal plate structure and stacked together in the vertical direction. The first terminals 14 are arranged in a horizontal direction perpendicular to the vertical direction. The first terminal 14 extends along a third direction perpendicular to the vertical direction and the horizontal direction. The first terminal 14 includes a first deflectable contacting arm 15 and a first connecting foot 16. The first deflectable contacting arm 15 of the first terminal block 10 and the first deflectable contacting arm 15 of the second terminal block 11 bend face to face and form an inserting space in the vertical direction. The third terminal block 20 includes a second insulative plate 22 and a plurality of second terminals 24 fixed in the second insulative plate 22. The second insulative plate 22 of the third terminal block 20 and the second insulative plate 22 of the fourth terminal block 21 are shaped as a horizontal plate structure. The second insulative plate 22 of the third terminal block 20 is stacked at a lateral side of the first insulative plate 12 of the first terminal block 10 in the vertical direction. The second insulative plate 22 of the fourth terminal block 21 is stacked at a lateral side of the first insulative plate 12 of the second terminal block 21 in the vertical direction. The second terminals 24 are arranged in the horizontal direction perpendicular to the vertical direction. The second terminal 24 extends along the third direction perpendicular to the vertical direction and the horizontal direction. The second terminal 24 includes a second deflectable contacting arm 25 and a second connecting foot 26. The second deflectable contacting arm 25 of the third terminal block 20 and the second deflectable contacting arm 25 of the fourth terminal block 21 bend face to face and form an inserting space in the vertical direction. The second deflectable contacting arm 25 of the third terminal block 20 and the second deflectable contacting arm 25 of the fourth terminal block 21 are located in front of the first deflectable contacting arm 15 of the first terminal block 10 and the first deflectable contacting arm 15 of the second terminal block 11. The first deflectable arms 15 of the first and second terminal blocks 10,11 and the second deflectable arms 25 of the third and fourth terminal blocks 20,21 extend beyond the first and second insulative plate 12,22. The electrical connector 100 also includes a shielding plate 30 disposed between the first insulative plate 12 of the first terminal block 10 and the second insulative plate 22 of the third terminal block 20. The electrical connector 100 also includes another shielding plate 30 disposed between the first insulative plate 12 of the second terminal block 11 and the second insulative plate 22 of the fourth terminal block 21. Referring to FIGS. 6-7, each lateral side of the second insulative plate 22 of the third terminal block 20 defines three latching slots 221. Each lateral side of the second insulative plate 22 of the fourth terminal block 21 defines three latching slots 221. Each lateral side of the shielding plate 30 includes three latching arms 31. The latching arms 31 cooperate with the latching slots 221, respectively. The shielding plate 30 is fixed to the second insulative plate 22. The vertical direction is defined as a first direction, the horizontal direction is defined as a second direction.

Figure 3:
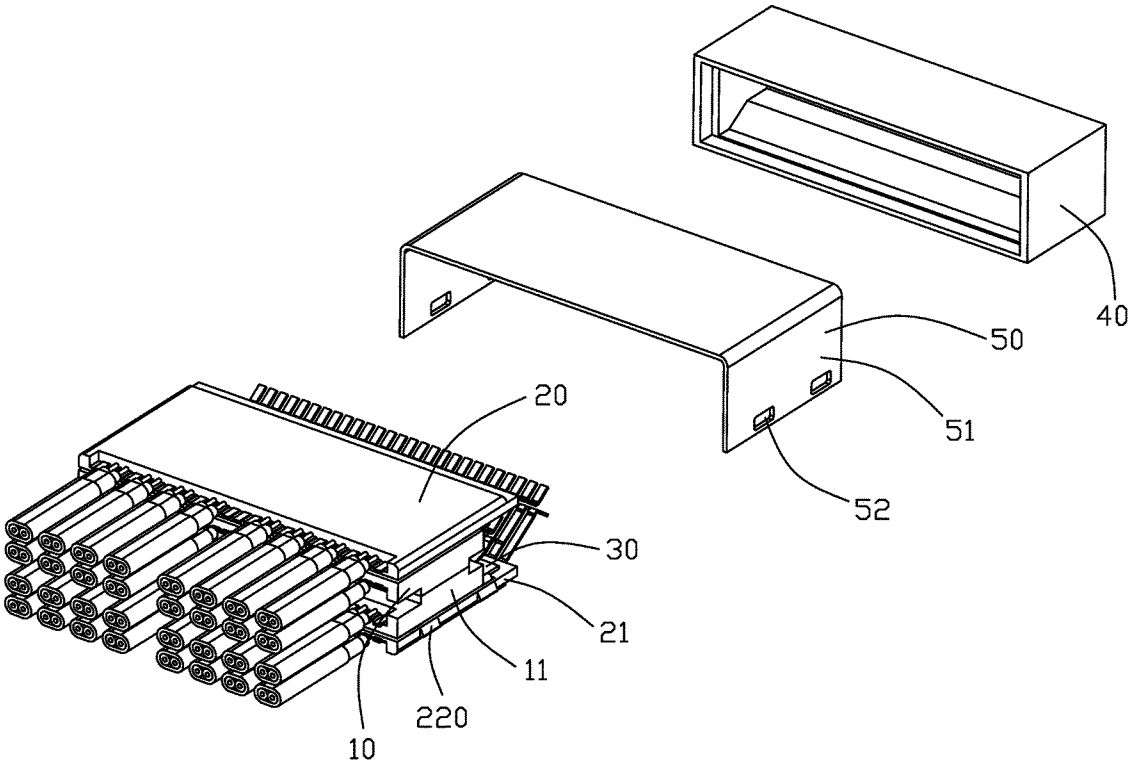
FIG. 3 is an exploded perspective view of the electrical connector and the cable shown in FIG. 1.
Figure 4:
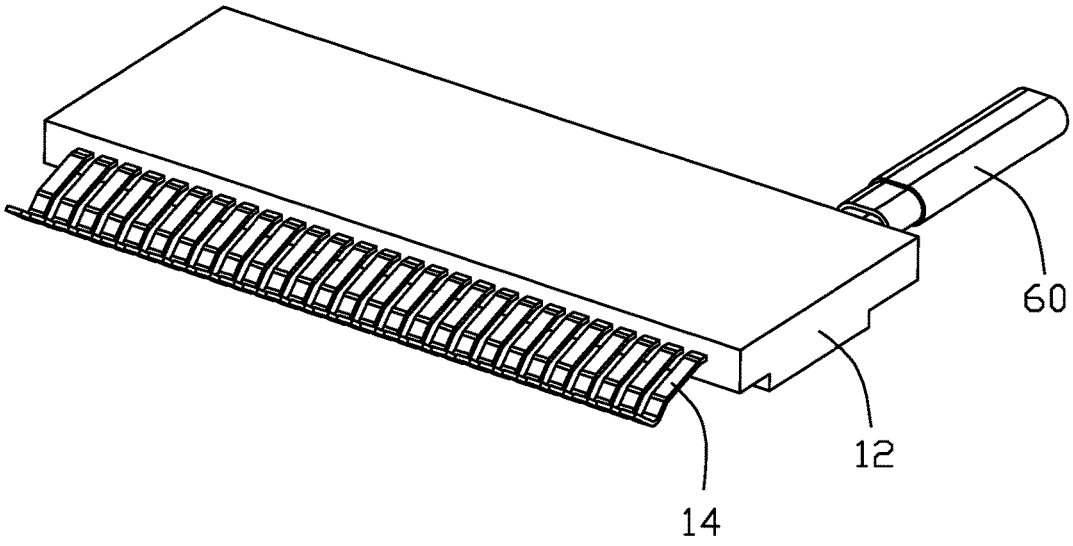
FIG. 4 is a perspective view of a first terminal block shown in FIG. 3.
Figure 5:
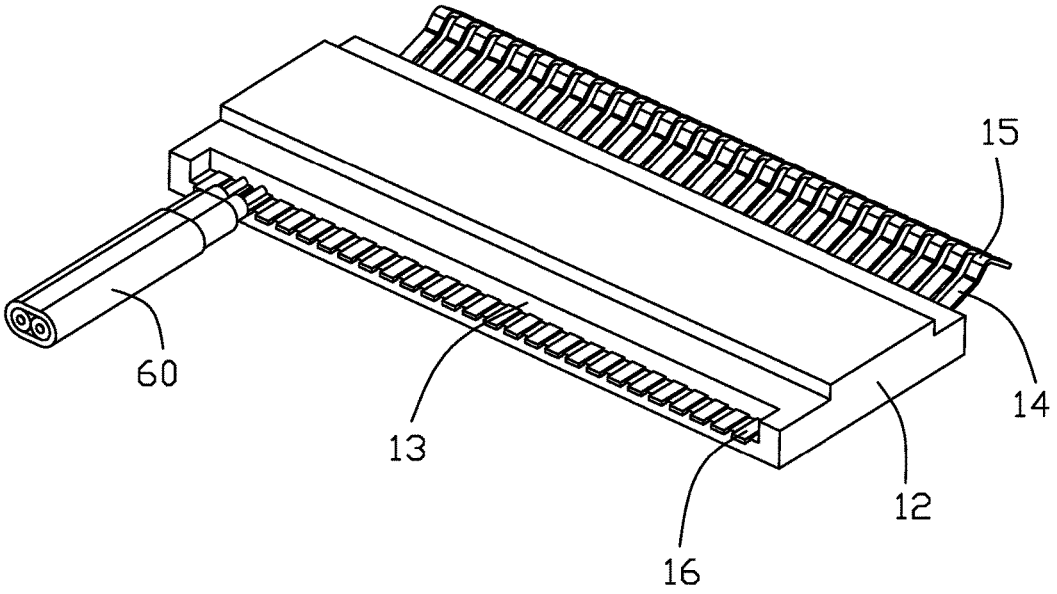
FIG. 5 is another perspective view of the first terminal block shown in FIG. 4.

Referring to FIGS. 1-3, the insulative shell 40 defines an opening. The insulative shell 40 covers the first insulative plate 12 and the second insulative plate 22. The insulative shell 40 surrounds the first deflectable contacting arms 15. The first deflectable contacting arm 15 is located behind the opening. The shielding shell 50 covers the first insulative plate 12 and the second insulative plate 22. The shielding shell 50 is located behind the insulative shell 40. Each lateral side of the second insulative plate 22 of the fourth terminal block 21 includes a plurality of protrusions 220. The shielding shell 50 includes three lateral walls 51. The shielding shell 50 also includes a plurality of fixing holes 52 for fixing to the protrusions 220, respectively. Each first insulative plate 12 defines a first slot 13 and each second insulative plate 22 defines a second slot 23. The first connecting foot 16 of the first terminal 14 is received in the first slot 13, and the second connecting foot 26 of the second terminal 24 is received in the second slot 23. The connecting foot of the terminal is soldered to a cable.

The first terminal block, the second terminal block, the third terminal block and the fourth terminal block are stacked together in the first direction. A height of the electrical connector can be adjusted by changing the number of terminal blocks. So, the electrical connector can mate with many different kinds of Central Processing Units.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

a first terminal block and a second terminal block stacked together along a first direction; wherein each of the first terminal block and the second terminal block has a first insulative plate and a plurality of first terminals fixed in the first insulative plate, the first terminals are arranged along a second direction perpendicular to the first direction, the first terminal extends along a third direction perpendicular to the first direction and the second direction, the first terminal has a deflectable contacting arm and a connecting foot, the deflectable contacting arm of the first terminal block and the deflectable contacting arm of the second terminal block bend in a face to face style to form an inserting space in the first direction;

further comprising a third terminal block stacked at a lateral side of the first terminal block and a fourth terminal block stacked at a lateral side of the second terminal block, each of the third terminal block and the fourth terminal block having a second insulative plate and a plurality of second terminals fixed in the second insulative plate, the deflectable contacting arm of the third terminal block and the deflectable contacting arm of the fourth terminal block bend in a face to face style to form an inserting space in the first direction, the deflectable contacting arms of the third terminal block and the fourth terminal block disposed in front of the deflectable contacting arms of the first terminal block and the second terminal block.

2. The electrical connector as claimed in claim 1, further comprising an insulative shell defining an opening, the deflectable contacting arms of the first terminal block, the second terminal block, the third terminal block and the fourth terminal block extending forwardly beyond the first insulative plate and the second insulative plate, respectively, the insulative shell covering the first insulative plate and the second insulative plate, the insulative shell surrounding the deflectable contacting arms, the deflectable contacting arms being located behind the opening.

3. The electrical connector as claimed in claim 2, further comprising a shielding shell, the shielding shell covering the first insulative plate and the second insulative plate, the shielding shell being located behind the insulative shell.

4. The electrical connector as claimed in claim 3, wherein each lateral side of the second insulative plate of the third terminal block and the fourth terminal block has a plurality of protrusions, the shielding shell having three side walls and a plurality of fixing holes for fixing to the protrusions, respectively.

5. The electrical connector as claimed in claim 1, further comprising a shielding plate disposed between the first insulative plate of the first terminal block and the second insulative plate of the third terminal block and another shielding plate disposed between the first insulative plate of the second terminal block and the second shielding plate of the fourth terminal block.

6. The electrical connector as claimed in claim 1, wherein each of the first insulative plate and the second insulative plate defines a slot to receive the connecting feet of the first terminal and the second terminal.

7. The electrical connector as claimed in claim 1, wherein the connecting foot of each terminal block is soldered to a cable.

8. An electrical connector comprising:

a first terminal block and a second terminal block stacked together in a vertical direction; wherein each of the first terminal block and the second terminal block includes a first insulative plate and a plurality of first terminals fixed in the first insulative plate, the first insulative plate of the first terminal block and the first insulative plate of the second terminal block are shaped as a horizontal plate structure and stacked together in the vertical direction, the first terminals are arranged along a horizontal direction, the first terminal has a deflectable contacting arm and a connecting foot, the deflectable contacting arm of the first terminal block and the deflectable contacting arm of the second terminal block form an inserting space in the vertical direction;

further comprising a third terminal block stacked at the lateral side of the first terminal block and a fourth terminal block stacked at the lateral side of the second terminal block, each of the third terminal block and the fourth terminal block comprises a second insulative plate and a plurality of second terminals fixed in the second insulative plate, the deflectable contacting arms of the third terminal block and the fourth terminal block bend in a face to face style in the vertical direction, the second terminal extending along a third direction perpendicular to the vertical direction and the horizontal direction, the second terminal having a deflectable contacting arm and a connecting foot, the deflectable contacting arms of the third terminal block and the fourth terminal block being disposed in front of the deflectable contacting arms of the first terminal block and the second terminal block.

9. A cable connector assembly comprising:

a first terminal block including a first insulative plate with a plurality of first contacts embedded therewithin via a first insert-molding process, said first contacts being arranged with one another along a transverse direction, each of said first contacts extending along a front-to-back direction perpendicular to said transverse direction and including a first front deflectable contacting section and a first rear connecting section;

a plurality of first cables electrically and mechanically connected, along the first-to-back direction, to the corresponding first rear connecting sections, respectively, a second terminal block including a second insulative plate with a plurality of second contacts embedded therewithin via a second insert-molding process, said second contacts being arranged with one another along the transverse direction, each of said second contacts extending along the front-to-back direction and including a second front deflectable contacting section and a second rear connecting section;

a plurality of second cables electrically and mechanically connected, along the front-to-back direction, to the corresponding second rear connecting sections, respectively; and a metallic shielding plate sandwiched between the first terminal block and the second terminal block in a vertical direction perpendicular to said front-to-back direction and said transverse direction; wherein said first contacts and said second contacts are aligned with each other in the vertical direction, and said first cables and said second cables are aligned with each other in the vertical direction; wherein the first front deflectable contacting sections and the second front deflectable contacting sections both point along a same vertical direction.

10. The cable connector assembly as claimed in claim 9, wherein the second insulative plate extends forwardly beyond the first insulative plate in said front-to-back direction, and the second front deflectable contacting sections extend forwardly beyond the corresponding first deflectable contacting sections in the front-to-back direction, respectively.

11. The cable connector assembly as claimed in claim 10, wherein the second front deflectable contacting sections extend toward the corresponding first front deflectable contacting sections in the vertical direction, respectively, so as to have corresponding second contacting points aligned with the corresponding first contacting point along the front-to-back direction, and coplanar with corresponding first contacting points in a horizontal plane defined by the transverse direction and the front-to-back direction.

12. The cable connector assembly as claimed in claim 11, further including an insulative housing enclosing both said first contacting points and said second contacting points.

13. The cable connector assembly as claimed in claim 12, wherein said first terminal block and said second terminal block are assemble together within a metallic case.

14. The cable connector assembly as claimed in claim 13, wherein the first rear connecting sections and the second rear connecting sections are directed in an opposite manner in said vertical direction.

15. The cable connector assembly as claimed in claim 14, wherein said first terminal block, said second terminal block and said shielding plate commonly form a first half part, and said cable connector assembly further includes a second half part same with the first half part while stacked with the first half part in an opposite manner so as to form an insert slot between the corresponding first contacting points and second contacting points of the first half part and those of the second half part in the vertical direction.

16. The cable connector assembly as claimed in claim 15, wherein said insulative housing encloses both the first contacting points and second contacting points of the first half part and those of the second half part.

17. The cable connector assembly as claimed in claim 16, wherein said metallic case encloses both the first half part and the second half part.

* * * * *